US005324013A

United States Patent [19]

Marino

[11] Patent Number: 5,324,013

[45] Date of Patent: Jun. 28, 1994

[54] CLAMPING MECHANISM

[76] Inventor: Michael L. Marino, 6456 Hollow Tree Ct., Saline, Mich. 48176

[21] Appl. No.: 509

[22] Filed: Jan. 5, 1993

[51] Int. Cl.[5] ..... B25B 1/12

[52] U.S. Cl. ..... 269/137

[58] Field of Search ..... 269/210–212, 269/137, 246

[56] References Cited

U.S. PATENT DOCUMENTS

| | | | |
|---|---|---|---|
| 540,413 | 6/1845 | Vanderbeek | 269/137 |
| 776,558 | 12/1904 | Scoggins . | |
| 2,707,419 | 5/1955 | Schron . | |
| 3,088,729 | 5/1963 | Marcus | 269/212 |
| 3,248,122 | 4/1966 | Roddy | 269/137 |
| 3,406,958 | 10/1968 | Geneloni et al. | 269/137 |
| 4,049,253 | 9/1977 | Mandel . | |
| 4,489,927 | 12/1984 | Yamada et al. . | |
| 4,643,411 | 2/1987 | Izumi . | |
| 4,713,515 | 12/1987 | Choi . | |
| 4,736,935 | 4/1988 | Vasapolli | 269/210 |
| 4,773,839 | 9/1988 | Case et al. . | |
| 4,805,889 | 2/1989 | Liepse | 269/210 |
| 4,930,760 | 6/1990 | Mirkovic . | |
| 4,986,519 | 1/1991 | Lee . | |
| 5,071,109 | 12/1991 | Yonezawa | 269/137 |

FOREIGN PATENT DOCUMENTS

| | | | |
|---|---|---|---|
| 1121559 | 1/1962 | Fed. Rep. of Germany . | |
| 3437604 | 10/1984 | Fed. Rep. of Germany . | |
| 443859 | 4/1950 | Italy | 269/137 |
| 125665 | 7/1949 | Sweden | 269/210 |
| 1693 | of 1902 | United Kingdom | 269/210 |
| 676052 | 7/1952 | United Kingdom | 269/137 |
| 938404 | 10/1963 | United Kingdom . | |
| 2187121 | 9/1987 | United Kingdom . | |

OTHER PUBLICATIONS

TecNara, Catalog 792, TecNara Tooling Systems, Inc. Niki Spanntechnik Ltd., Prowat Services, Inc., International Spare Parts and Services.

*Primary Examiner*—Robert C. Watson
*Attorney, Agent, or Firm*—Gossett Dykema

[57] ABSTRACT

An improved clamp assembly includes a first clamp jaw having a plurality of incremental teeth on a lower surface which selectively mate with teeth on a clamp body. The teeth on the first clamp jaw end at one end at a tooth root and at the other end on an incline beyond and above the predetermined location of a tooth root. In this way, the first clamp jaw may be reversed to provide fine control over the incremental adjustable position of the first clamp jaw relative to the clamp body. In another feature of the present invention the other clamp jaw is a wedge-type clamp jaw having a threaded member with two enlarged portions received in a bore in the clamp jaw. The enlarged portions ensure that the threaded member is effective to move the wedge clamp jaw upwardly and downwardly relative to the clamp body. This is an improvement over prior art wedge-type clamp jaws which required complicated spring arrangements.

9 Claims, 1 Drawing Sheet

CLAMPING MECHANISM

BACKGROUND OF THE INVENTION

This application in general relates to improvements in clamping mechanisms which allow rapid clamping and unclamping of parts to be machined.

Clamps are known for holding parts to be machined. In general, such clamps require undesirably large amount of times to clamp and unclamp the parts. When large numbers of parts are being machined, this requirement of clamping and unclamping the prior art clamping structures requires large amounts of set-up toime which is unduly expensive and time-consuming.

In one known type of prior art clamp, one of the clamp jaws includes teeth on a bottom face which mate with teeth on a clamp body such that the clamp face may be set at any one of a number of incrementally adjusted positions relative to the clamp body. Such clamp structures have benefits over the typical prior art clamps in that the clamp jaw may be quickly set a relatively accurate position. This reduces set-up time somewhat. Even so, the incremental adjustment of the clamp jaw reduces the freedom of positioning of the clamp jaw. This is undesirable.

In other prior art structures, it is known to mount a clamp jaw along an inclined face of the clamp body such that when a threaded member is tightened the clamp jaw moves along the inclined face and wedges against a part to be clamped. Such clamp jaws have not been successfully incorporated into practical clamp systems. In large part it is believed that this is because they have been unduly complicated, requiring springs or other types of elements for returning the clamp jaw to its upward position upon release.

SUMMARY OF THE INVENTION

In a disclosed embodiment of the present invention, teeth are formed along the bottom of one clamp jaw and are selectively positioned on mating teeth on a clamp body. In this way, the toothed clamp jaw can be positioned at any one of a number of incremental positions relative to the clamp body. This allows that clamp jaw to be set at a position such that it is relatively accurately positioned relative to the other clamp jaw for the given part to be machined. Moreover, by selecting a desired tooth on the clamp body a number of clamps can be set up by positioning the clamp jaw at that desired tooth. This reduces set-up time over the prior art. In are inventive feature, the clamp jaw is machined such that at one end the tooth ends at one end at a tooth root and at the other end on an incline that extends from the crest most proximate to the end to the predetermined location of a root and beyond and above that predetermined location. This effectively reduces the incremental adjustment in half. By selectively reversing the clamp jaw, one can reduce in half the restriction to movement of the clamp jaw relative to the clamp body.

In another feature of the present invention, the second clamp jaw is a wedge-type clamp jaw mounted on an inclined surface. A threaded member extends through a bore in the clamp jaw and is rotatable relative to the clamp jaw to tighten and loosen the clamp jaw relative to the clamp body. The threaded member has two radially enlarged portions spaced about a central smaller portion. A smaller portion of the bore receives the smaller portion of the threaded member. Thus, the two enlarged portions of the threaded member are received on each side of the smaller portion of the bore. This locks the threaded member within the clamp jaw such that when the threaded member is moved to loosen or tighten the clamp jaw, the clamp jaw moves with the threaded member. In a most preferred embodiment of the present invention, the threaded member is formed by inserting it through a bore in the clamp jaw, and then fixing a nut on the threaded member such that it rotates with the threaded member, providing one of the two enlarged portions.

These and other features and objects of the present invention can be best understood from the following specification and drawings, of which the following is a brief description.

DETAILED DESCRIPTION OF A PREFERRED EMBODIMENT

Figure 1:
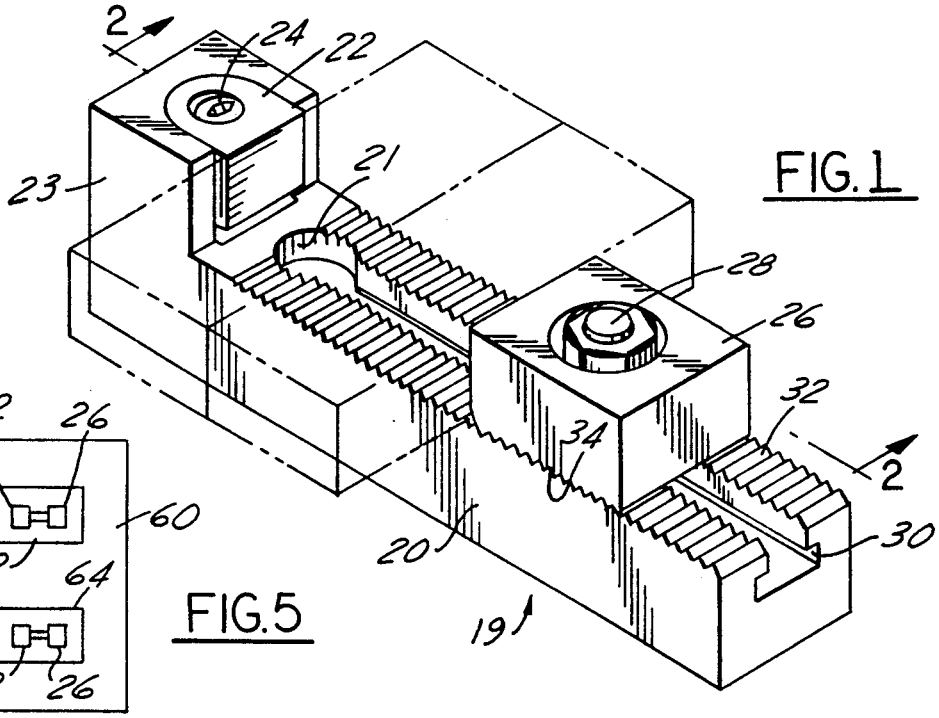
FIG. 1 is a perspective view of an inventive clamp according to the present invention.

An inventive clamp system 19 incorporates a clamp body 20 which may be secured to a base by bolts extending through holes 21. A first wedge-type clamp jaw 22 is mounted at one end in a body portion 23. A threaded member 24 is adjusted within wedge clamp jaw 22 to adjust its position towards and away from a second clamp jaw 26. Second clamp jaw 26 receives a bolt 28 having a T-shaped head which is adjustable in a T-shaped slot 30 formed in clamp body 20. A number of incremental teeth 32 are formed on an upper surface of clamp body 22, and mating teeth 34 are formed on an undersurface of second clamp jaw 26. When one wishes to clamp a part in clamp assembly 19, one initially places a part between clamp jaw 22 and clamp jaw 26, preferably in contact with clamp jaw 22. One then moves clamp jaw 26 towards the part such that the incremental teeth 34 mate with desired teeth 32 at a position where clamp jaw 26 is as close to the part as possible. As will be explained below, in one feature of this invention, the teeth are formed such that there is a fine degree of control over this positioning. One then tightens threaded member 24 to bring clamp jaw 22 into contact with the part, securely clamping the part between jaws 22 and 26. This will be explained below.

Figure 2:
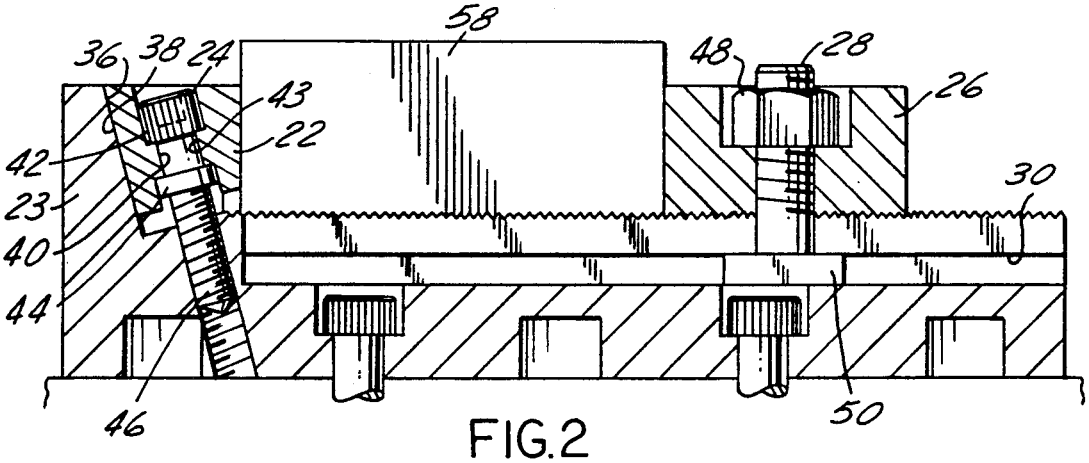
FIG. 2 is a cross-sectional views through the inventive clamp.

As shown in FIG. 2, clamp jaw 22 includes threaded member 24 which slides along an inclined surface 36 in body portion 23. Clamp jaw 22 has a mating inclined surface 38. As threaded member 24 is tightened in clamp body portion 23, clamp jaw 22 has surface 38 sliding along surface 36. This in turn causes clamp jaw 22 to move towards clamp jaw 26 to clamp a part.

As shown, threaded member 24 extends through a bore 40 in clamp jaw 22. Threaded member 24 includes spaced enlarged portions 42 and 44. In the illustrated embodiment enlarged portion 44 is a nut which is secured to the threaded member 24. An intermediate smaller portion 43 of bore 40 extends into a smaller portion of threaded member 24 such that smaller portion 43 is captured between enlarged portions 42 and 44.

An inner end 46 of threaded member 24 is received in a threaded bore in clamp body 20. When one turns threaded member 24 within clamp jaw 22, it may rotate within bore 40. As it rotates, it brings clamp body 22 downwardly with surface 38 sliding on surface 36. During this downward movement, clamp jaw 22 is caused to move towards clamp jaw 26. When one wishes to loosen a part, one reverses the rotation of threaded member 24. At this time enlarged portion 44 serves to pull clamp jaw 22 back upwardly. This is an improvement over prior art wedge-type clamping members wherein complicated spring arrangements were required for this return movement.

As also shown, a nut 48 is received on bolt 28. Head 50 is received within T-shaped slot 30 such that clamp jaw 26 may be moved along clamp body 20 towards and away from clamp jaw 22 to a desired position. When at the desired position nut 48 is tightened to secure clamp jaw 26 on clamp body 20.

Figure 3:
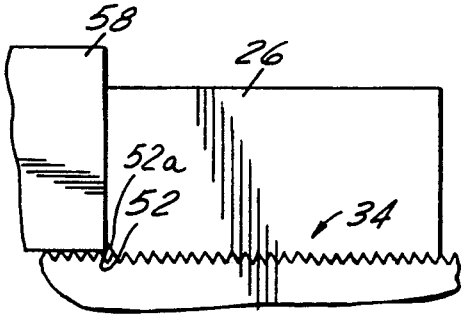
FIGS. 3 and 4 show a positioning feature of this invention.
Figure 4:
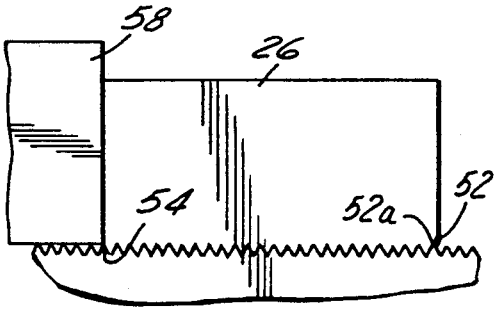

As shown in FIGS. 3 and 4, teeth 34 extend below the second clamp jaw 26, between the ends of the second clamp jaw 26. At one end, the teeth 34 end in a root 54 and at the other end, on an incline that extends from the crest most proximate to this other end to the predetermined location of a root 54*a* and beyond and above that predetermined location to the end 52 of the incline, which is the end of the second clamp jaw 26 of the teeth. In this way, an assembler can reverse the position of clamp jaw 26 relative to clamp body 20 to achieve fine control over the incremental position of clamp jaw 26 relative to clamp body 20. As an example, clamp jaw 26 is shown in FIG. 3 with the end 52 of the incline positioned towards clamp jaw 22. If this were reversed and clamp jaw 26 had its end with a root 54 positioned closer to clamp jaw 22, clamp jaw 26 would be found at the position shown in FIG. 4. The difference in position is about one-half the distance between the teeth. Thus, the degree of control over the position of clamp jaw 26 relative to clamp jaw 22 is half of the distance between the teeth on the clamp jaw 26 and body 20. In this way it is relatively easy to clamp a part 58 between clamp jaws 22 and 26.

In a method of assembling clamp assembly 19, one initially places a part 58 adjacent clamp jaw 22. One then brings clamp jaw 26 to a position such that it is close to part 58. One determines which position of clamp jaw 26 would bring it closest to the part, and the clamp jaw 26 is then secured at that location by tightening nut 48. One then turns threaded member 24 to bring clamp jaw 22 into abutting contact with the part 58, which then also contacts clamp jaw 26, clamping the part 58.

Figure 5:
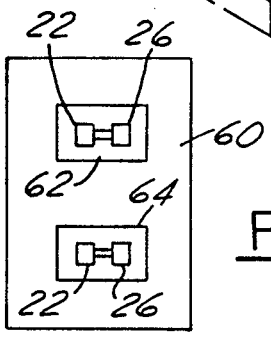
FIG. 5 is a somewhat schematic view showing a set-up incorporating a number of the inventive clamp systems.

As shown in FIG. 5, base 60 may receive a plurality of clamping elements 62 and 64. Although only two are shown, it should be understood that in a typical machining operation dozens of such assemblies may be utilized. When dozens of such assemblies are utilized even a small time-saving is magnified proportionally. When plural ones of the clamp assemblies are used to machine identical parts one need only determine which particular position for clamp 26 is necessary for the first part. One may then set the other clamp jaw 26 at the same location to achieve similar results. This results in a significant reduction in the assembly time required.

Although a preferred embodiment of the present invention has been disclosed it should be understood that certain modifications would come within the scope of this invention. For that reason the following claims should be studied in order to determine the true scope and content of this invention.

I claim:

1. A clamp assembly comprising:

a first clamp jaw;

a second clamp jaw spaced from said first clamp jaw and selectably movable towards and away from said first clamp jaw;

a clamp body having a concavity including a substantially round inclined surface defining said concavity, said second clamp jaw being received in said concavity, said inclined surface supporting said second clamp jaw and at least partially surrounding said second clamp jaw, said second clamp jaw having a substantially round inclined surface slidable along said inclined surface of said clamp body, a threaded member rotatable relative to said second clamp jaw, and a bore extending through said second clamp jaw, said threaded member extending through said bore in said second clamp jaw, said threaded member having two spaced apart radially enlarged threaded member portions and a radially smaller threaded member portion disposed between said two enlarged threaded member portions and said bore having two correspondingly spaced apart radially enlarged bore portions receiving said enlarged threaded member portions and said bore having a correspondingly radially smaller bore portion receiving said smaller threaded member portion such that, when said threaded member is turned relative to tighten said second clamp jaw, a first of said enlarged threaded member portions moves said clamp downwardly, and when said threaded member is moved to loosen said clamp jaw, a second of said enlarged portions moves said clamp jaw upwardly.

2. A clamp assembly as received in claim 1, wherein one of said two enlarged threaded member portions is a nut fixed to said threaded member.

3. A clamp assembly as recited in claim 1, wherein there are plural groups of first and second clamp jaws.

4. A clamp assembly comprising:

a clamp body comprising a plurality of incremental clamp body teeth at an upper surface;

a first clamp jaw having a plurality of incremental first clamp teeth on a lower surface, said plurality of first clamp teeth having alternating crests and roots at predetermined locations and including inclines, each joining a crest to a root above said crest, and said plurality of said first clamp teeth extending between a first end of said first clamp jaw and a second end of said first clamp jaw, selectively mating with said clamp body teeth, said first clamp teeth ending at a root at said first end, and said first clamp teeth ending at said second end on an incline that extends from the crest most proximate to said second end to the end of the incline which is the end of the first clamp jaw; and a second clamp jaw spaced from said first clamp jaw and selectively movable towards and away from said first clamp jaw, said first clamp jaw being reversible so that said first end is disposed between said second end and said second clamp jaw for one orientation of said first clamp and said second end is disposed between said first end and said second clamp jaw for another orientation of said first clamp.

5. A clamp assembly as recited in claim 1, wherein a bolt extends through a central bore in said first clamp jaw, and has a head received in a T-shape slot in said clamp body, and a nut is selectively tightenable on said bolt to fix said first clamp jaw relative to said clamp body.

6. A clamp as recited in claim 4, wherein said second clamp jaw is a wedge-type clamp jaw having a threaded member which is received in said clamp body, and said second clamp jaw having an inclined surface supported on a mating inclined surface of said clamp body such that when said threaded member is turned said second clamp jaw moves along said inclined surfaces and towards or away from said first clamp body.

7. A clamp assembly as recited in claim 6, wherein said threaded member has enlarged portions spaced axially on both sides of a smaller portion, said threaded member being rotatably received in a bore in said second clamp jaw.

8. A clamp assembly as received in claim 1, wherein each of said substantially round inclined surface defining said concavity and said substantially round inclined surface of said second clamp jaw is at least partially semicircular.

9. A clamp assembly as received in claim 1, wherein the incline at said second end extends twice the length of each of the other inclines.

* * * * *